US009596533B2

(12) United States Patent
Akino

(10) Patent No.: US 9,596,533 B2
(45) Date of Patent: Mar. 14, 2017

(54) UNIDIRECTIONAL CLOSE-TALKING MICROPHONE AND MICROPHONE CAP

(71) Applicant: Kabushiki Kaisha Audio-Technica, Tokyo (JP)

(72) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

(21) Appl. No.: 14/796,197

(22) Filed: Jul. 10, 2015

(65) Prior Publication Data

US 2016/0037254 A1 Feb. 4, 2016

(30) Foreign Application Priority Data

Jul. 30, 2014 (JP) ..... 2014-154451

(51) Int. Cl.

| | |
|---|---|
| ***H04R 3/00*** | (2006.01) |
| ***H04R 1/34*** | (2006.01) |
| *H04R 1/08* | (2006.01) |
| *H04R 1/10* | (2006.01) |

(52) U.S. Cl.

CPC ..... *H04R 1/342* (2013.01); *H04R 1/083* (2013.01); *H04R 1/1083* (2013.01)

(58) Field of Classification Search

CPC ..... H04R 1/1083; H04R 1/342; H04R 1/083
See application file for complete search history.

(56) References Cited

U.S. PATENT DOCUMENTS

| | | | | |
|---|---|---|---|---|
| 2009/0279712 | A1* | 11/2009 | Gollbach | H04R 1/086 381/71.6 |
| 2010/0260369 | A1* | 10/2010 | Suzuki | H04R 1/342 381/360 |
| 2012/0207336 | A1* | 8/2012 | Matsui | H04R 1/086 381/361 |
| 2013/0064409 | A1* | 3/2013 | Ikeda | H04R 1/08 381/356 |

FOREIGN PATENT DOCUMENTS

| | | |
|---|---|---|
| JP | 6286796 | 6/1987 |
| JP | 1321780 | 12/1989 |
| JP | 2000184490 A | 6/2000 |
| JP | 2012169886 A | 9/2012 |

* cited by examiner

*Primary Examiner* — Regina N Holder
(74) *Attorney, Agent, or Firm* — Whitham, Curtis & Cook, P.C.

(57) ABSTRACT

The orientation of the directional axis and the directionality of a microphone are adjusted through a simple configuration. A unidirectional close-talking microphone includes a microphone unit including a front sound-collecting segment and a rear sound-collecting segment; and a microphone cap attachable to the outer circumference of the microphone cap, the microphone cap including a plurality of sound-collecting holes on a side face, the relative position between the microphone cap and the microphone unit being switchable between a first position and a second position along the central axis, the sound-collecting holes being disposed on opposite sides of the central axis at different positions along the central axis, the rear sound-collecting segment being in communication with outside of the microphone cap through the sound-collecting holes in the microphone cap when the microphone cap resides at the first position, part of the rear sound-collecting segment being covered with the microphone cap when the microphone cap resides at the second position.

10 Claims, 12 Drawing Sheets

UNIDIRECTIONAL CLOSE-TALKING MICROPHONE AND MICROPHONE CAP

BACKGROUND OF THE INVENTION

Technical Field

The present invention relates to a unidirectional close-talking microphone and a microphone cap.

Background Art

Unidirectional close-talking microphones are used close to the mouths of talkers. An example of the close-talking microphones is one attached to a headset. Close-talking microphones are often used at outdoor events.

A unidirectional close-talking microphone collects popping noise caused by plosive sounds if the directional axis of the microphone is disposed toward the mouth of a talker. Thus, the angle of the directional axis of the unidirectional close-talking microphone is adjusted relative to the talker to avoid collection of popping noise.

In a high level of ambient noise, the directional axis of the unidirectional close-talking microphone must be directed toward the mouth of the talker to collect the clear voice of the talker certainly.

Ideally, the directional axis of the microphone should be directed away from the mouth of the talker at a low level of ambient noise, and should be directed toward the mouth at a high level of ambient noise. Such a configuration can collect the clear voice of the talker at any level of ambient noise.

It is known that bidirectional microphones can collect less noise than unidirectional microphones. Specifically, when noise is generated in all directions, the noise level collected by a bidirectional microphone is approximately ⅓ of that collected by a unidirectional microphone. That is, the anti-noise ability of bidirectional microphones is better than that of unidirectional microphones.

Thus, the noise level collected by a microphone in a high level of ambient noise can be reduced through shift of the directionality of the microphone from unidirectionality to bidirectionality.

A requirement for unidirectional close-talking microphones mounted on headsets is a simple configuration that can vary the directionality and the orientation of the directional axes.

Microphones have been known that have caps covering the sound collectors of the microphone units and being rotatably supported by the casings of the microphone units (for example, Japanese Unexamined Patent Application Publication No. 2012-169886 (hereinafter, Reference 1)).

Reference 1 does not describe a configuration that can vary the directionality and the orientation of the directional axis of the microphone.

Microphones have been known that have multiple acoustic-pressure communication holes in the front and side faces of cabinets, and can continuously vary the directionality from unidirectionality to nondirectionality through sliding of shutters, which is in contact with the interior or exterior of the cabinets (for example, Japanese Unexamined Utility Model Application Publication No. 62-86796 (hereinafter, Reference 2)).

Other microphones have been known that can vary the degree of projection of the microphone units depending on the operating mode set by mode switchers (for example, Japanese Unexamined Patent Application Publication No. 2000-184490 (hereinafter, Reference 3)).

Unfortunately, the microphones according to References 2 and 3 cannot vary the orientation of the directional axes.

Video cameras have been known that mix audio signals from multiple microphones having different directionalities at mixing ratios corresponding to the zoom ratios of imaging lenses (for example, Japanese Unexamined Patent Application Publication No. 1-321780 (hereinafter, Reference 4)).

Unfortunately, the video camera according to Reference 4 requires multiple microphones and thus inevitably has a complicated configuration.

SUMMARY OF THE INVENTION

Technical Problem

An object of the present invention is to provide a unidirectional close-talking microphone that can adjust the directionality and the orientation of the directional axis of the microphone through a simple configuration and to provide a microphone cap.

Solution to Problem

A unidirectional close-talking microphone according to an aspect of the present invention includes a microphone unit including a front sound-collecting segment and a rear sound-collecting segment; and a microphone cap attachable to the outer circumference of the microphone cap, the microphone cap comprising a plurality of sound-collecting holes on a side face, the relative position between the microphone cap and the microphone unit being switchable between a first position and a second position along the central axis, the sound-collecting holes being disposed on opposite sides of the central axis at different positions along the central axis, the rear sound-collecting segment being in communication with outside of the microphone cap through the sound-collecting holes in the microphone cap when the microphone cap resides at the first position, part of the rear sound-collecting segment being covered with the microphone cap when the microphone cap resides at the second position.

A microphone cap according to another aspect of the present invention, which is disposed at a variable position relatively to the position of a microphone unit along an axial direction, includes a casing attachable to the microphone unit; and a plurality of sound-collecting holes disposed in a side face of the casing, the sound-collecting holes including: a first sound-collecting hole; a plurality of second sound-collecting holes disposed in the side face the casing at positions corresponding to the positions of holes in a rear sound-collecting segment; and a third sound-collecting hole disposed on a side of the central axis opposite to the first sound-collecting hole and at a position along the central axis different from the position of the first sound-collecting hole, the microphone cap being switchable between a first position and a second position along the central axis relative to the microphone unit, the holes in the rear sound-collecting segment being in communication with outside the microphone unit through the second sound-collecting holes when the microphone cap resides at the first position, some of the holes in the rear sound-collecting segment being in communication with the first sound-collecting hole and the other holes in the rear sound-collecting segment being covered with the microphone cap when the microphone cap resides at the second position.

Advantageous Effects of Invention

The present invention can provide a microphone that can adjust the directionality and the orientation of the directional axis of the microphone through a simple configuration.

DESCRIPTION OF THE PREFERRED EMBODIMENT

A unidirectional close-talking microphone and a microphone cap (hereinafter referred to as "microphone") according to embodiments of the present invention will now be described with reference to the accompanying drawings.

Microphone 1

An embodiment of the microphone will now be described.

Figure 1:
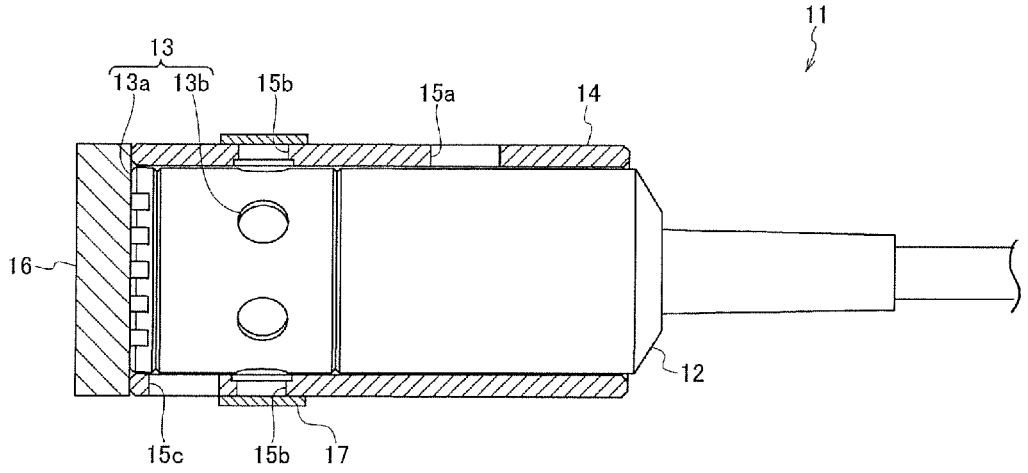
FIG. 1 is a partial cross-sectional view of a variable-directionality close-talking microphone according to an embodiment of the present invention.

With reference to FIG. 1, the microphone 11 includes a microphone unit 12 and a microphone cap 14. FIG. 1 illustrates the microphone 11 when the microphone cap 14 resides at a first position. At the first position, the front end of the microphone cap 14 is disposed close to the end edge of the microphone unit 12.

In the embodiments, the term "front" refers to the sound collecting direction of the microphone unit 12. This corresponds to the left in FIG. 1.

The microphone 11 is a unidirectional microphone. The microphone 11 may be any type of microphone, for example, a condenser microphone or a dynamic microphone.

Configuration of Microphone Unit 12

The microphone unit 12 has an outer cylindrical shape and collects ambient sound. The microphone unit 12 includes a sound collector 13.

The sound collector 13 includes a front sound-collecting segment 13*a* and a rear sound-collecting segment 13*b*. The front sound-collecting segment 13*a* is provided on the front face of the microphone unit 12. The front sound-collecting segment 13*a* collects sound in the space in communication with the front sound-collecting segment 13*a*. The front acoustic terminals of the microphone unit 12 are defined at or near the holes in the front sound-collecting segment 13*a*. The rear acoustic terminals of the microphone unit 12 are defined at or near the holes in the rear sound-collecting segment 13*b*.

The term "acoustic terminal" refers to the aerial position that effectively applies acoustic pressure to the microphone unit 12. Specifically, the acoustic terminal is the central position in the air that flows in response to the movement of a diaphragm provided in the microphone unit 12. The unidirectional microphone unit 12 has acoustic terminals at the front and rear of a diaphragm.

The holes in the rear sound-collecting segment 13*b* are provided along the circumferential surface of the microphone unit 12. The holes in the rear sound-collecting segment 13*b* collect sound in the surrounding space in communication with the holes in the rear sound-collecting segment 13*b*.

The directional axis of the microphone unit 12 is substantially identical with the central axis of the microphone unit 12.

Configuration of Microphone Cap 14

With reference to FIG. 1, the microphone cap 14 is attachable to the outer circumference of the microphone unit 12. The casing of the microphone cap 14 has the same shape as that of the microphone unit 12. The casing of the microphone cap 14 according to this embodiment has a cylindrical shape, for example. The relative positioning between the microphone cap 14 and the microphone unit 12 is variable along the central axis of the microphone unit 12. The microphone cap 14 is composed of plastic, for example. The central axis of the microphone cap 14 is aligned with the central axis of the microphone unit 12.

Figure 2:
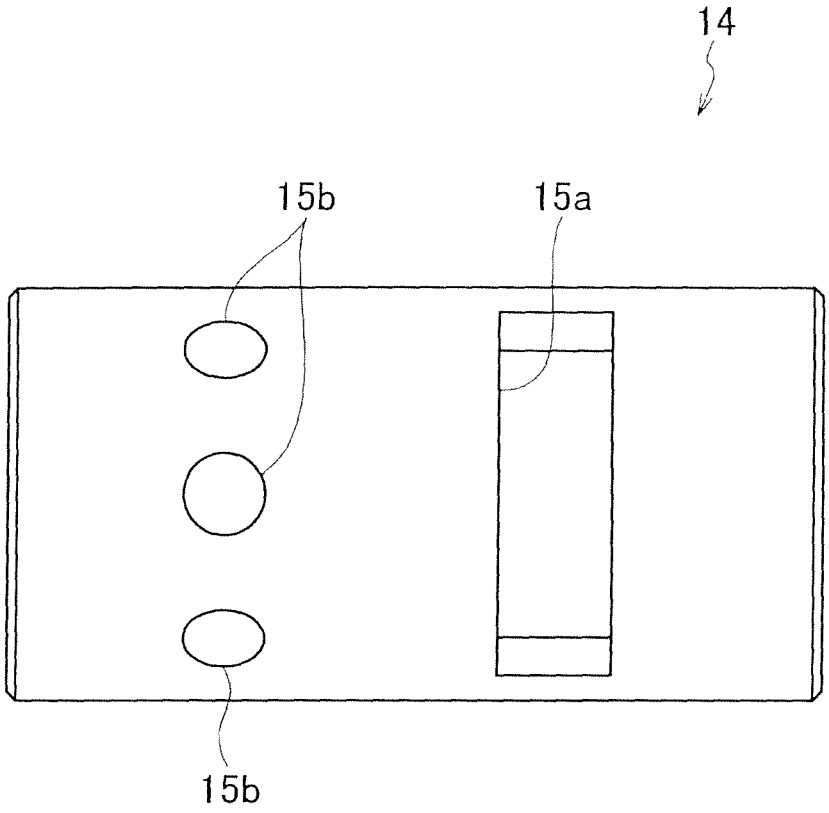
FIG. 2 is a side view of a microphone cap of the variable-directionality close-talking microphone according to an embodiment.

With reference to FIG. 2, the microphone cap 14 includes a first sound-collecting hole 15*a*, second sound-collecting holes 15*b*, a third sound-collecting hole 15*c* (shown in FIG. 3), and acoustic resistors 16 and 17 (shown in FIG. 1).

The front end of the microphone cap 14 is open. This open end of the microphone cap 14 is covered with the acoustic resistor 16. The microphone unit 12 can be disposed inside the microphone cap 14 through the opening.

The first sound-collecting hole 15*a* is provided on the side face of the microphone cap 14. The first sound-collecting hole 15*a* is provided in part of the side face of the microphone cap 14. The first sound-collecting hole 15*a* is, for example, a rectangular hole having the long side disposed along the circumferential direction of the microphone cap 14.

The third sound-collecting hole 15*c* is provided on the side face of the microphone cap 14, like the first sound-collecting hole 15*a*. The third sound-collecting hole 15*c* is a rectangular hole having the long side disposed along the circumferential direction of the microphone cap 14. The size of the third sound-collecting hole 15*c* is substantially identical with that of the first sound-collecting hole 15*a*. The third sound-collecting hole 15*c* is provided in part of the side face of the microphone cap 14. The first sound-collecting hole 15*a* and the third sound-collecting hole 15*c* are formed with a milling machine, for example.

Figure 3:
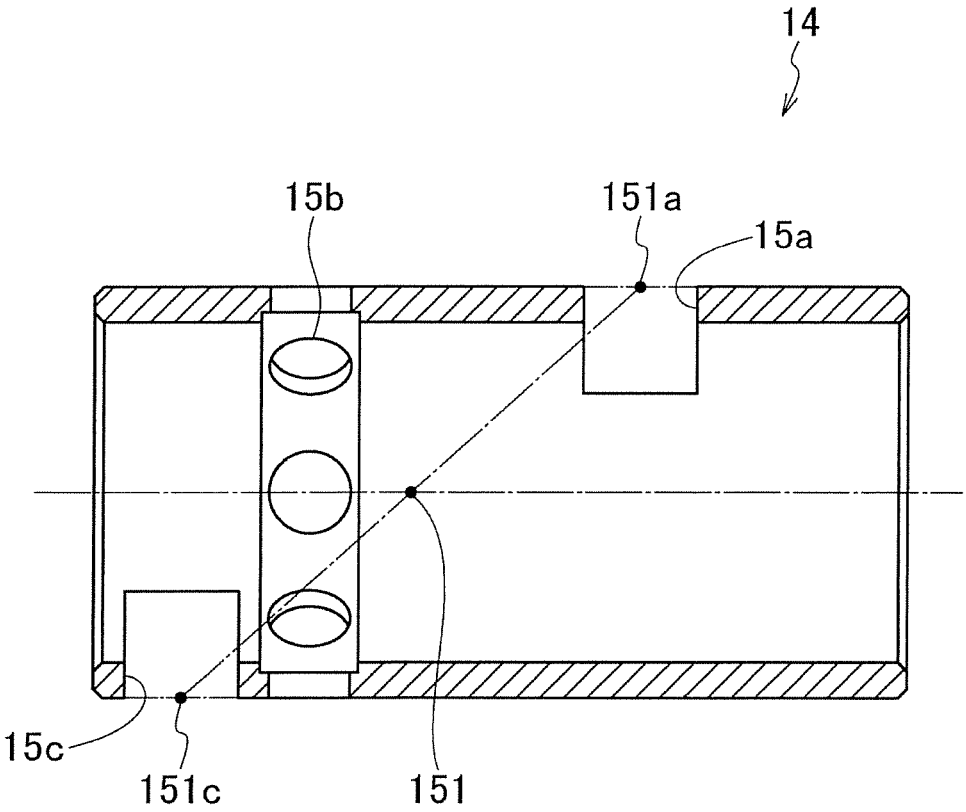
FIG. 3 is a cross-sectional view of the microphone cap.
Figure 4:
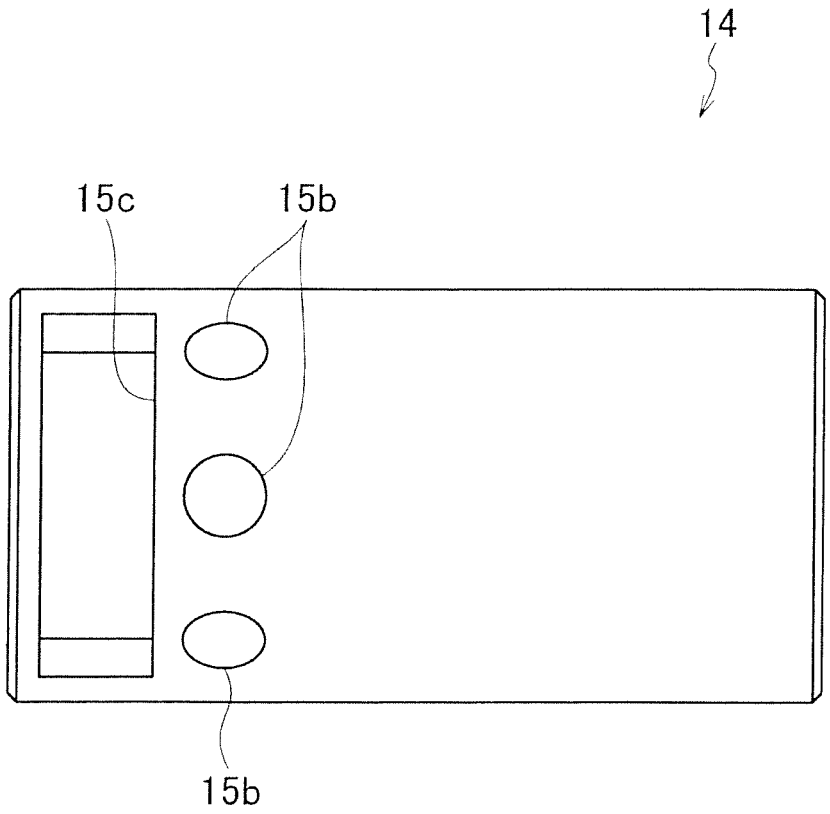
FIG. 4 is a side view of a side having a third sound-collecting hole in the microphone cap.

With reference to FIG. 3, the first sound-collecting hole 15*a* and the third sound-collecting hole 15*c* are provided on opposite sides of and at different positions along the central axis of the microphone cap 14. The third sound-collecting hole 15*c* is provided in front of the first sound-collecting hole 15*a*.

The middle point 151*a* of the external side of the cross-section of the first sound-collecting hole 15*a* and the middle point 151*b* of the external side of the cross-section of the third sound-collecting holes 15*c* are symmetrical to the point 151 on the axis of the microphone cap 14.

A state in which the microphone cap 14 being fit around the microphone unit 12 will now be described. If the microphone cap 14 is in the first position relative to the microphone unit 12, the first sound-collecting hole 15*a* and the third sound-collecting hole 15*c* have no communication with the sound collector 13 of the microphone unit 12.

The second sound-collecting holes 15*b* are substantially circular holes provided in the side face of the microphone cap 14 along the circumferential direction. The second sound-collecting holes 15*b* are provided between the first sound-collecting hole 15*a* and the third sound-collecting hole 15*c*. The second sound-collecting holes 15*b* are covered with the acoustic resistor 17 attached to the exterior of the microphone cap 14.

The second sound-collecting holes 15*b* are provided at positions corresponding to the holes in the rear sound-collecting segment 13*b* of the microphone unit 12. At the first position illustrated in FIG. 1, the second sound-collecting holes 15*b* are in communication with the holes in the rear sound-collecting segment 13*b*.

The acoustic resistors 16 and 17 are composed of polyester cotton or sponge, for example.

Figure 5:
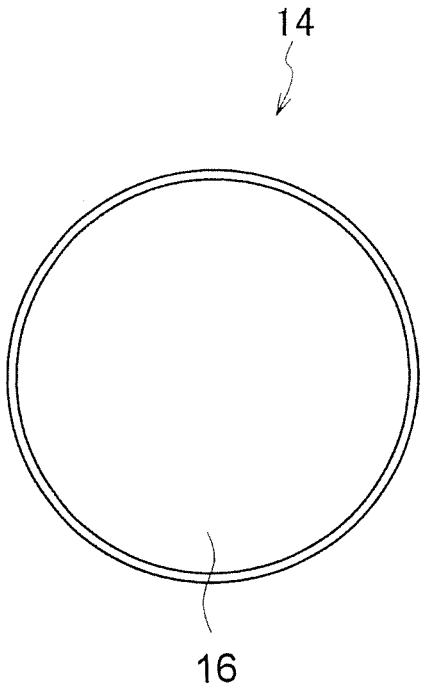
FIG. 5 is a front view of the microphone cap.

FIG. 5 is a front view of the microphone cap 14. FIG. 5 illustrates the microphone cap 14 in view from the sound collecting direction.

The position of the microphone cap 14 can be switched between the first and the second positions, which are described below. The microphone cap 14 is held at the first or second position, for example, by friction generated at the contact surface between the microphone cap 14 and the microphone unit 12.

Protrusions and depressions may be provided at the positions for switching of the microphone cap 14. For example, the protrusions may be provided on one of the surfaces of the microphone cap 14 and the microphone unit 12 in contact with each other. The depressions may be provided on the other surface.

The protrusions and the depressions are engaged to hold the position of the microphone cap 14. This engagement precisely adjusts and holds the position of the microphone cap 14 relative to the microphone unit 12. The microphone cap 14 can be switched between the first and second positions through the fitting of the protrusions and the depressions.

Alternatively, the microphone cap 14 and the microphone unit 12 may have any known sliding mechanism, such as a spring sliding mechanism.

Relative Position between Microphone Cap 14 and Microphone Unit 12

The relationship between the position of the microphone cap 14 and the properties of the microphone 11 will now be described.

The collection of acoustic waves when the microphone cap 14 resides at the first position will now be described. FIG. 1 illustrates the microphone cap 14 at the first position.

The front sound-collecting segment 13*a* collects sound from the outside of the microphone 11 through the acoustic resistor 16. The rear sound-collecting segment 13*b* collects sound from the outside of the microphone 11 through the acoustic resistor 17 and the second sound-collecting holes 15*b*.

When the microphone cap 14 resides at the first position, the front acoustic terminals of the microphone 11 are defined at or near the holes in the front sound-collecting segment 13*a*. The rear acoustic terminals of the microphone 11 are defined at or near the holes in the rear segment 13*b*.

Figure 6:
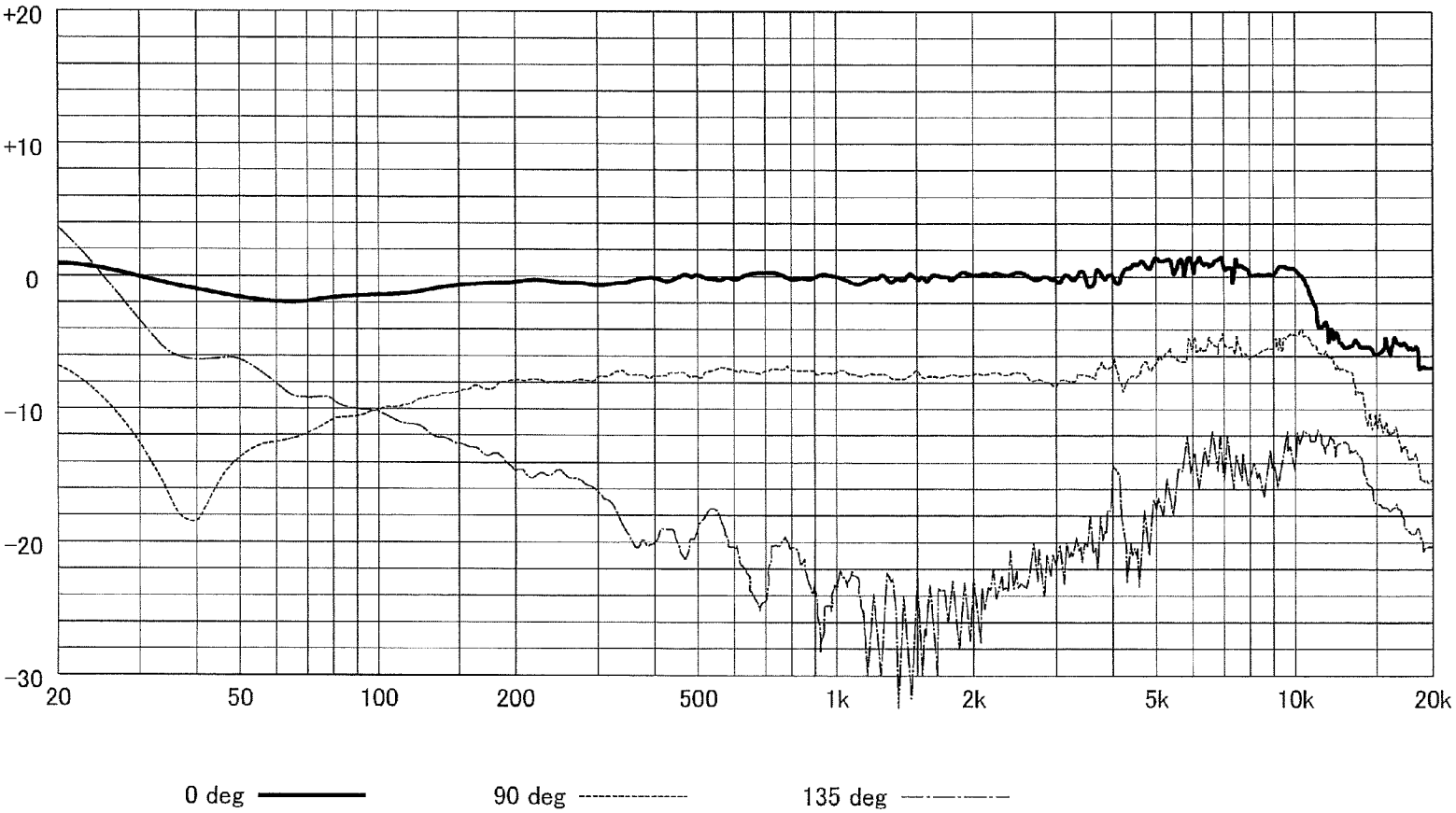
FIG. 6 is a graph illustrating the frequency characteristics when the microphone cap resides at a first position.
Figure 7:
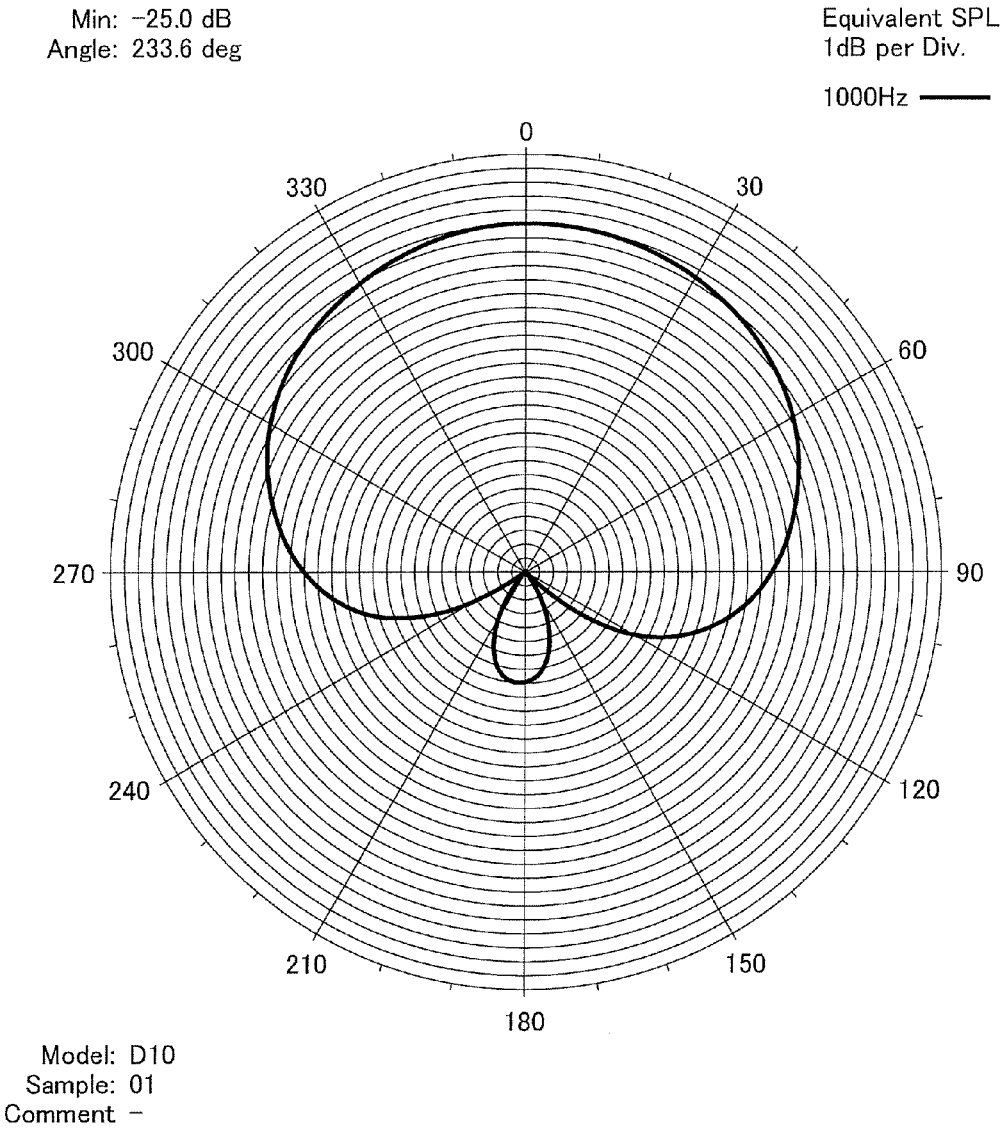
FIG. 7 is a graph illustrating the orientation of the directional axis and the directionality when the microphone cap resides at the first position.

When the microphone cap 14 resides at the first position, the microphone 11 has unidirectionality, as illustrated in FIGS. 6 and 7. The directional axis of the microphone 11 extends toward zero degrees in FIG. 7 or the front of the microphone unit 12.

Figure 8:
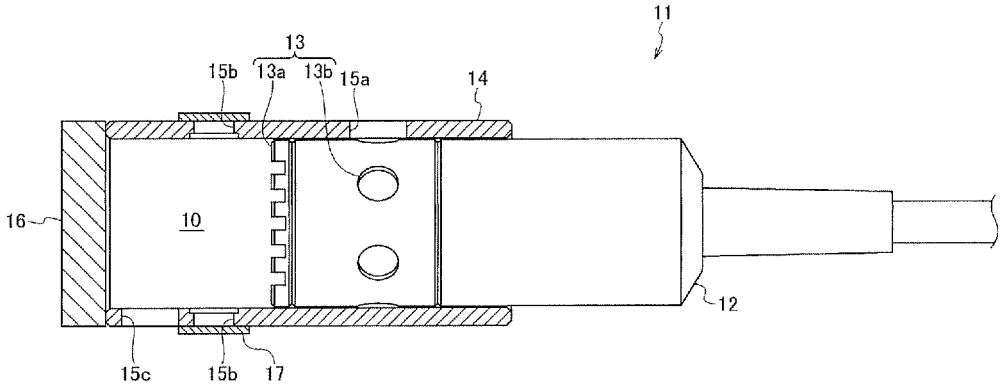
FIG. 8 is a partial cross-sectional view of the microphone cap at a second position.

The collection of acoustic waves by the microphone cap 14 at the second position will now be described with reference to FIG. 8.

The front end of the microphone cap 14 is displaced from the front end of the microphone unit 12. The front face of the microphone cap 14 and the front face of the microphone unit 12 are separated by a space 10.

The first sound-collecting hole 15*a* is in communication with some of the holes in the rear sound-collecting segment 13*b* in the microphone unit 12. The other holes in the rear sound-collecting segment 13*b* are covered with the microphone cap 14. The second sound-collecting holes 15*b* and the third sound-collecting hole 15*c* are in communication with the front sound-collecting segment 13*a*.

The front sound-collecting segment 13*a* collects external sound entering the microphone 11 via the acoustic resistor 16, the second sound-collecting holes 15*b*, and the third sound-collecting hole 15*c*. The external sound collected through the third sound-collecting hole 15*c* is the dominant sound collected by the front sound-collecting segment 13*a*. The rear sound-collecting segment 13*b* collects external sound through the first sound-collecting hole 15*a*.

That is, at the second position, the front acoustic terminals of the microphone 11 reside at the central aerial positions that effectively apply acoustic pressure to the microphone unit 12 by external sound entering the microphone 11 via the acoustic resistor 16, the second sound-collecting holes 15*b*, and the third sound-collecting hole 15*c*.

The rear acoustic terminals of the microphone 11 are the central aerial positions that effectively apply acoustic pressure to the microphone unit 12 by external sound collected by the rear sound-collecting segment 13*b* through the first sound-collecting hole 15*a*. Thus, the rear acoustic terminals of the microphone unit 12 reside near the first sound-collecting hole 15*a*.

At the second position, the microphone 11 also collects sound through the first sound-collecting hole 15*a* and the third sound-collecting hole 15*c*. The directional axis of the microphone 11 at the second position tilts toward the line connecting the third sound-collecting hole 15*c* and the first sound-collecting hole 15*a* more than the directional axis of the microphone 11 at the first position.

Figure 9:
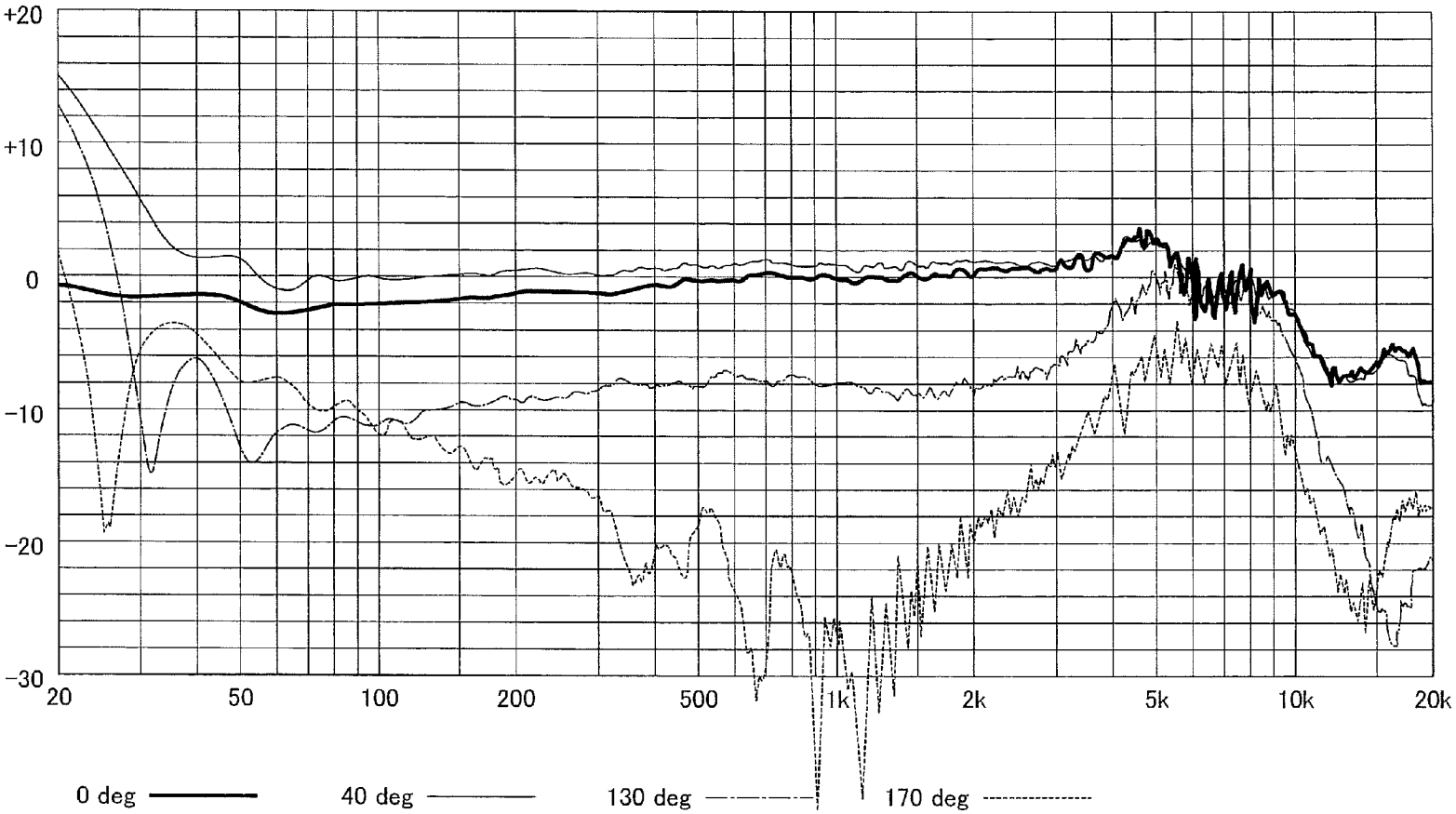
FIG. 9 is a graph illustrating the frequency characteristics when the microphone cap resides at the second position.
Figure 10:
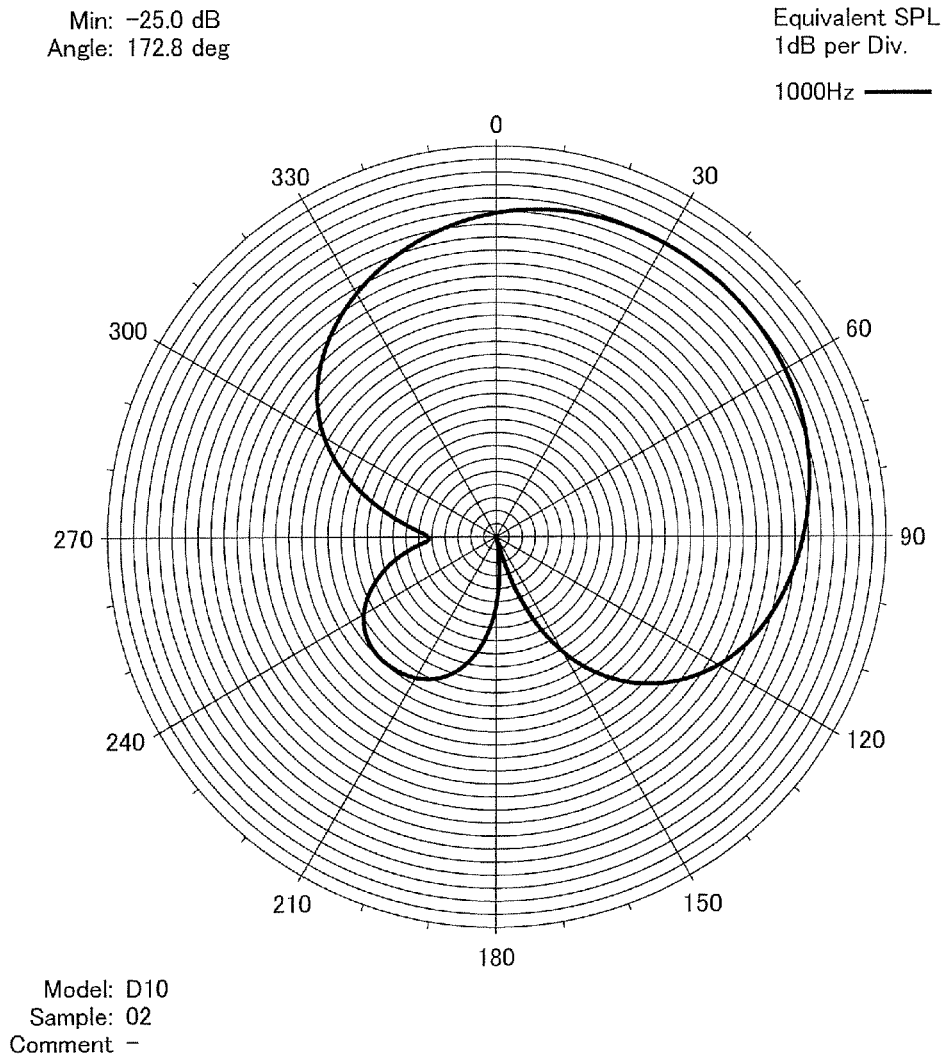
FIG. 10 is a graph illustrating the orientation of the directional axis and the directionality when the microphone cap resides at the second position.

With reference to FIGS. 9 and 10, the directionality of the microphone 11 at the second position shifts toward bidirectionality.

The front end of the microphone cap 14 of the microphone 11 at the second position is displaced from the front end of the microphone unit 12. Specifically, the front acoustic terminals are disposed near the third sound-collecting hole 15*c*, and the rear acoustic terminals are disposed near the first sound-collecting hole 15*a*. Thus, the microphone 11 is more bidirectional at the second position than that at the first position. In other words, the microphone 11 is bidirectional rather than unidirectional at the second position in which the sound-collecting axis is the imaginary line segment connecting the middle point 151*a* of the external side of the cross-section of the first sound-collecting hole 15*a* and the middle point 151*c* of the external side of the cross-section of the third sound-collecting hole 15*c*, as illustrated in FIG. 3.

The microphone 11 having bidirectionality can collect sound containing a reduced level of ambient noise component.

According to this embodiment, the orientation of the directional axis of the microphone 11 is approximately 40 degrees when the microphone cap 14 resides at the second position.

Figure 11:
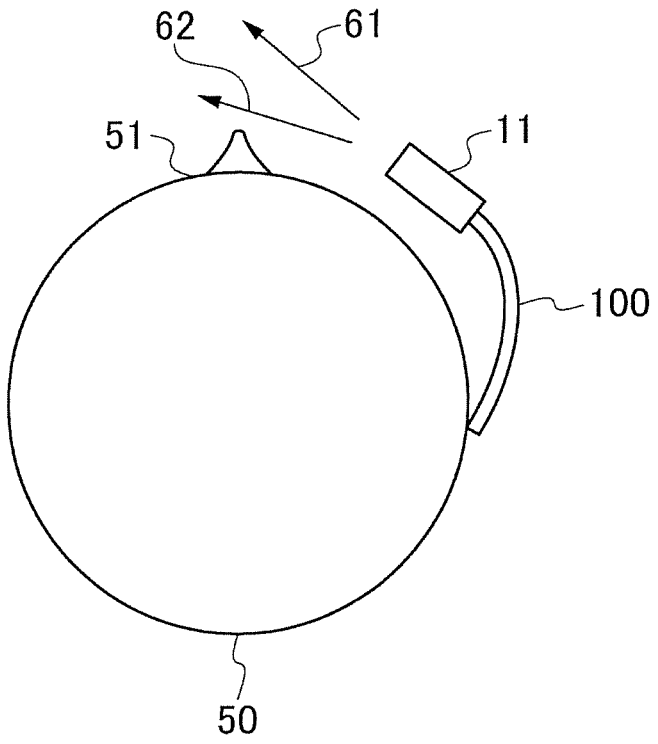
FIG. 11 is a schematic view illustrating a headset including a unidirectional close-talking microphone according to an embodiment of the present invention worn by a user.

FIG. 11 illustrates a headset 100 including the microphone 11 worn by a user 50. The microphone 11 is attached to the distal end of the arm of the headset 100. The microphone 11 is held in the vicinity of the mouth 51 of the user 50.

The arrow 61 indicates the orientation of the directional axis when the microphone cap 14 resides at the first position. The arrow 61 extends away from the mouth 51. The arrow 62 indicates the orientation of the directional axis when the microphone cap 14 resides at the second position. The arrow 62 approaches the mouth 51.

When the microphone cap 14 resides at the first position, the microphone 11 has a directional axis extending away from the mouth 51 and thus does not collect popping noise. When the microphone cap 14 resides at the second position, the microphone 11 has a directional axis approaching the mouth 51 and thus can certainly collect the clear voice of the user 50 even in a high level of ambient noise.

According to the embodiment described above, the shift of the relative position between the microphone unit 12 and the microphone cap 14 along the axial direction can vary the directionality and the orientation of the directional axis of the microphone.

Microphone 2

A microphone according to another embodiment will now be described with focus on the components different from those in the embodiment described above. This embodiment differs from the embodiment described above in that an acoustic resistor covers a front sound-collecting segment and a first sound-collecting hole.

Figure 12:
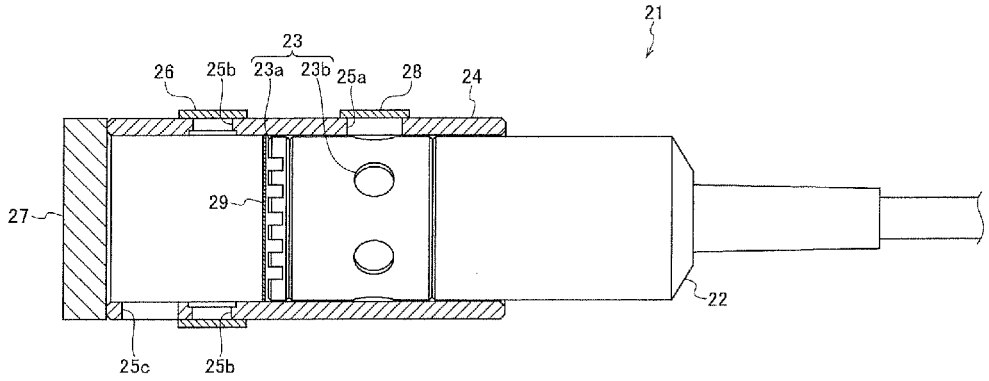
FIG. 12 is a partial cross-sectional view of a unidirectional close-talking microphone according to another embodiment of the present invention.

With reference to FIG. 12, a microphone 21 includes a microphone unit 22 and a microphone cap 24. The microphone unit 22 includes a sound collector 23. The sound collector 23 includes a front sound-collecting segment 23*a* and a rear sound-collecting segment 23*b*. The microphone cap 24 includes a first sound-collecting hole 25*a*, second sound-collecting holes 25*b*, a third sound-collecting hole 25*c*, and acoustic resistors 26 to 29.

The acoustic resistor 28 is attached to the exterior of the microphone cap 24. The acoustic resistor 28 covers the first sound-collecting hole 25*a*. When the microphone cap 24 resides at a second position, the sound that passes through the acoustic resistor 28 is collected by the rear sound-collecting segment 23*b* of the microphone unit 22 through the first sound-collecting hole 25*a*.

The acoustic resistor 29 covers the front sound-collecting segment 23*a* of the microphone unit 22. When the microphone cap 24 resides at the second position, the sound that passes through the third sound-collecting hole 25*c* passes through the acoustic resistor 29 and is collected by the front sound-collecting segment 23*a* of the microphone unit 22.

The acoustic resistors 26 to 29 may be composed of any material that damps the vibration of air, such as a windshield.

The acoustic resistor 28 and 29 cover the first sound-collecting hole 25*a* and the front sound-collecting segment 23*a*, respectively, to reduce the level of popping noise in the sound collected at the second position.

The invention claimed is:

1. A unidirectional close-talking microphone comprising:

a microphone unit comprising a front sound-collecting segment and a rear sound-collecting segment; and a microphone cap attachable to the outer circumference of the microphone unit, the microphone cap comprising a plurality of sound-collecting holes on a side face, a relative position between the microphone cap and the microphone unit being switchable between a first position and a second position along a central axis, the sound-collecting holes being disposed on opposite sides of the central axis at different positions along the central axis, the rear sound-collecting segment being in communication with outside of the microphone cap through the sound-collecting holes in the microphone cap when the microphone cap resides at the first position, part of the rear sound-collecting segment being covered with the microphone cap when the microphone cap resides at the second position, and an acoustic resistor configured to cover a front face of the microphone cap.

2. The unidirectional close-talking microphone according to claim 1, wherein, a front end of the microphone cap resides in the vicinity of the front end of the microphone unit at the first position, and the front end of the microphone cap is displaced from the front end of the microphone unit at the second position.

3. The unidirectional close-talking microphone according to claim 1, wherein, the rear sound-collecting segment has holes, the sound-collecting holes comprise:

a first sound-collecting hole;

a plurality of second sound-collecting holes disposed in a side face of the microphone cap at positions corresponding to the positions of the holes in the rear sound-collecting segment; and a third sound-collecting hole is disposed on a side of the central axis opposite to the first sound-collecting hole and at a position along the central axis different from the position of the first sound-collecting hole, the second sound-collecting holes are in communication with the respective holes in the rear sound-collecting segment when the microphone cap resides at the first position, and the first sound-collecting hole is in communication with some of the holes in the rear sound-collecting segment and the third sound-collecting hole is in communication with the front sound-collecting segment when the microphone cap resides at the second position.

4. The unidirectional close-talking microphone according to claim 1, wherein at least one of the sound-collecting holes is covered with an acoustic resistor.

5. The unidirectional close-talking microphone according to claim 1, wherein the microphone unit has unidirectionality.

6. The unidirectional close-talking microphone according to claim 1, wherein the front sound-collecting segment is covered with the acoustic resistor.

7. The unidirectional close-talking microphone according to claim 1, wherein the orientation of a directional axis and a directionality are variable through shift of the relative position between the microphone cap and the microphone unit along the central axis.

8. A microphone cap disposed at a variable position relative to the position of a microphone unit along an axial direction, the microphone cap comprising:

a casing attachable to the microphone unit; and a plurality of sound-collecting holes disposed in a side face of the casing, the sound-collecting holes comprising:

a first sound-collecting hole;

a plurality of second sound-collecting holes disposed in the side face the casing at positions corresponding to positions of holes in a rear sound-collecting segment of the microphone unit; and a third sound-collecting hole disposed on a side of a central axis opposite to the first sound-collecting hole and at a position along the central axis different from the position of the first sound-collecting hole, the microphone cap being switchable between a first position and a second position along the central axis relative to the microphone unit, the holes in the rear sound-collecting segment being in communication with outside the microphone unit through the second sound-collecting holes when the microphone cap resides at the first position, some of the holes in the rear sound-collecting segment being in communication with the first sound-collecting hole and the other holes in the rear sound-collecting segment being covered with the microphone cap when the microphone cap resides at the second position, and an acoustic resistor configured to cover a front face of the microphone cap.

9. The microphone cap according to claim 8, wherein at least one of the sound-collecting holes is covered with an acoustic resistor.

10. The microphone cap according to claim 8, wherein the orientation of a directional axis and a directionality of the microphone unit is variable through shift of the relative position between the microphone cap and the microphone unit along the axial direction.

* * * * *